US006694114B2

(12) United States Patent
Matsuduki

(10) Patent No.: US 6,694,114 B2
(45) Date of Patent: Feb. 17, 2004

(54) IMAGE FORMING APPARATUS AND IMAGE FORMING METHOD

(75) Inventor: Masato Matsuduki, Kawasaki (JP)

(73) Assignee: Fujitsu, Limited, Kawasaki (JP)

( * ) Notice: Subject to any disclaimer, the term of this patent is extended or adjusted under 35 U.S.C. 154(b) by 0 days.

(21) Appl. No.: 10/119,830

(22) Filed: Apr. 11, 2002

(65) Prior Publication Data

US 2003/0113128 A1 Jun. 19, 2003

(30) Foreign Application Priority Data

Dec. 19, 2001 (JP) ..... 2001-386449

(51) Int. Cl.[7] ..... G03G 15/16; G03G 15/00
(52) U.S. Cl. ..... 399/66; 399/384
(58) Field of Search ..... 399/66, 310, 311, 399/312, 313, 314, 384

(56) References Cited

U.S. PATENT DOCUMENTS 5,926,669 A * 7/1999 Sugimoto et al. ..... 399/66
6,157,793 A * 12/2000 Weaver et al. ..... 399/66 X
6,292,649 B1 * 9/2001 Toyama et al. ..... 399/384
6,330,403 B1 * 12/2001 Tsujita et al. ..... 399/66 X
6,336,023 B1 * 1/2002 Toyama et al. ..... 399/66 X
6,404,998 B1 * 6/2002 Tanaka et al. ..... 399/66

FOREIGN PATENT DOCUMENTS

| | | |
|---|---|---|
| JP | 4-86842 | 3/1992 |
| JP | 5-281874 | 10/1993 |
| JP | 10-293474 | 11/1998 |

* cited by examiner

*Primary Examiner*—Sandra Brase
(74) *Attorney, Agent, or Firm*—Westerman, Hattori, Daniels & Adrian, LLP

(57) ABSTRACT

In an image forming apparatus that forms a toner image on a continuous medium, the tension force applied to the continuous medium by the image forming drum is controlled within a proper range. The apparatus comprises a toner image forming unit forms a toner image on a rotating image forming drum, a transfer unit that transfers, to the continuous medium, the toner image on the image forming drum by a transfer current, and a control unit that monitors the tension force applied to the continuous medium by the image forming drum and controls the transfer current at the transfer area, based on the results of this monitoring. Alternatively, the apparatus increases the minimum printing ratio by adding additional data to the print data.

14 Claims, 15 Drawing Sheets

21.2 × 21.2 μm／one mass for 1200 dpi

IMAGE FORMING APPARATUS AND IMAGE FORMING METHOD

BACKGROUND OF THE INVENTION

1. Field of the Invention

The present invention relates to an image forming apparatus and image forming method that form an image on a continuous medium using the electro-photographic process, and more particularly, to an image forming apparatus and image forming method that control the power with which the medium is conveyed by an image forming drum.

2. Description of the Related Art

Image forming apparatuses that employ the electrophotographic process are widely used in printers, copying machines and facsimile machines, etc. These apparatuses form a toner image on an image forming drum such as a photosensitive drum, and transfer the toner image to a printing medium, whereby an image is formed on the printing medium.

In a high-speed printer, in order to continuously carry out the transfer operation onto the medium, it is common to use a continuous medium such as continuous paper for the printing medium. FIG. 22 is an explanatory drawing of a conventional image forming apparatus using such a continuous medium.

Continuous paper having sprocket holes will be explained as an example of the continuous medium. The continuous paper 120 has sprocket holes at both edges, and is conveyed by tractor pins mounted on a tractor 110 located upstream from a photosensitive drum 100. Furthermore, a tractor 112 is located downstream from the photosensitive drum 100 where necessary, such that two tractors 110 and 112 conveys the continuous paper 120.

Because the continuous paper 120 is conveyed synchronously with the tractor pin conveyance speed, the conveyance speed v of the continuous paper is identical to the tractor pin speed. The photosensitive drum 100 is set to rotate at a circumferential speed (v+a) that is slightly higher than the paper speed v, such that the paper upstream from the photosensitive drum is prevented from slackening while variations in the drum diameter and other factors are taken into account.

The continuous paper 120 adheres to the photosensitive drum 100 at the transfer point, and transfer current is applied from the back side of the paper by a transfer charger 102, whereby the toner image on the photosensitive drum 100 is transferred to the continuous paper 120. When the continuous paper 120 comes into contact with the photosensitive drum 100 at the transfer point, the electrostatic attraction is generated between the continuous paper 120 and the photosensitive drum 100 due to the application of the transfer current.

As described above, because the speed of the photosensitive drum 100 is higher than the paper conveyance speed, an appropriate tension force F is applied to the continuous paper 120 upstream from the photosensitive drum 100, enabling preferable paper conveyance. The tractor 110 located upstream from the photosensitive drum 100 generates a reaction force that opposes this tension force F brought about by the photosensitive drum 100.

However, because the paper tension force F is the result of electrostatic attraction between the photosensitive drum 100 and the continuous paper 120, it is not fixed, and fluctuates. When the paper tension force is large, the paper elastically deforms and stretches, changing the transfer conditions. When the paper tension force is excessive, the sprocket holes in the continuous paper may tear, and the paper sections may become separated at the perforations in the paper.

In other words, because the paper tension force is applied at the transfer point by the photosensitive drum 100, if the paper tension force is large, the toner is transferred while the paper is stretched, and the tension is released and the paper returns to its original state after the transfer is performed. If the toner image is transferred while the paper is stretched, it is easy for the toner image to become blurred.

As a result, when the degree of paper tension force fluctuates in regard to a single page, the problem occurs that the toner image varies depending on the paper tension. This variation is not conspicuous in a low-resolution image having a resolution of around 240 dpi, in which the dot diameter is large, but in a high-resolution image having a resolution of around 1,200 dpi, in which the dot diameter is small, the variation becomes noticeable.

Furthermore, when the paper tension force fluctuates considerably, the paper begins fluttering near the transfer point, as shown in FIG. 23, causing the transfer conditions to change more significantly, and the paper also separates from the tractor or tears occur in the continuous paper.

One of the factors involved in this fluctuation is the amount of toner between the photosensitive drum 100 and the continuous paper 120, but the degree of fluctuation in the toner amount has normally been small in the conventional art, and fluctuations in the tension force generally did not become unduly large. However, in recent years, it has become desirable to use continuous paper output for not only internal documents and preliminary documents, but also for such official documents as invoices, receipts and other documents submitted to customers. In order to carry out clearer printing for such purposes, it is required to reduce extra toner fog on the photosensitive drum.

Consequently, due to the increased fluctuations in the amount of toner on the photosensitive drum and in the amount of paper tension, where there is a low printing ratio or little extra toner fog, there is an increased risk of excessive paper tension, leading to blurred characters, separation of the paper from the tractor or tearing of the paper.

SUMMARY OF THE INVENTION

Therefore, an object of the present invention is to provide an image forming apparatus and image forming method that maintain at an appropriate level the tension on the continuous medium caused by the image forming drum.

Another object of the present invention is to provide an image forming apparatus and image forming method that prevent the application of excessive tension to the continuous medium while at the same time preventing slack in the continuous medium.

Still another object of the present invention is to provide an image forming apparatus and image forming method that stabilize the characteristics of the conveyance of the continuous medium by the image forming drum.

Still another object of the present invention is to provide an image forming apparatus and image forming method that enable clear printing while maintaining at an appropriate level the tension on the continuous medium caused by the image forming drum.

In order to achieve these objects, the image forming apparatus of the present invention has feeding unit for feeding a continuous medium, toner image forming unit for forming a toner image on a rotating image forming drum, transfer unit for transferring to the continuous medium the toner image on the image forming drum by causing an electrostatic force to act on the image forming drum and the continuous medium at a transfer position via a transfer current, and control unit for monitoring the tension force applied by the image forming drum on the continuous medium and controls the value of the transfer current from the transfer unit in accordance with the results of such monitoring.

The image forming method according to the present invention has a step of forming a toner image on a rotating image forming drum, a step of transferring to a continuous medium the toner image on the image forming drum by causing an electrostatic force to act on the image forming drum and the continuous medium, which is being conveyed, at a transfer position via a transfer current, and a step of monitoring the tension force applied by the image forming drum on the continuous medium and controlling the value of the transfer current from the transfer unit in accordance with the results of such monitoring.

According to the present invention, because the tension force applied to the continuous medium by the image forming drum due to the electrostatic force impressed by the transfer apparatus in order to transfer the toner image from the image forming drum to the continuous medium is controlled, the amount of tension can be maintained at a proper level, the conveyance of the continuous medium can be conducted in a stable fashion, and good printing results can be obtained. Furthermore, because the tension force is monitored and controlled, it can be controlled within an appropriate range.

Furthermore, it is preferred that the control unit of the present invention monitors the printing ratio from the printing data used to form the toner image on the image forming drum, and that it control the value of the transfer current output from the transfer unit in accordance with the results of this monitoring. Because the tension force is proportional to the toner amount, the tension force applied by the image forming drum can be easily measured by monitoring the printing ratio that determines the toner amount.

Moreover, it is preferred that the control unit of the present invention monitors the current supplied to the motor that rotates the image forming drum, and that it control the value of the transfer current output from the transfer unit in accordance with the results of this monitoring. Because the tension force is proportional to the image forming drum motor current value, the tension force applied by the image forming drum can be easily measured by monitoring the motor current value.

In addition, it is preferred that the control unit of the present invention reduce the transfer current value where it is determined from the results of monitoring that the amount of tension is high, and increase the transfer current value where it is determined that the amount of tension is low.

It is furthermore preferred that the control unit of the present invention reduce the transfer current value where the printing ratio is low, and increase the transfer current value where the printing ratio is high.

It is also preferred that the control unit of the present invention reduces the transfer current value where the motor current value is large, and increase the transfer current value where the motor current value is small.

It is moreover preferred that the control unit of the present invention controls the transfer current value in accordance with the results of monitoring of the printing ratio after a prescribed delay interval following the point in time at which such monitoring is performed.

The other feature of the present invention comprises an image forming apparatus that forms a toner image on a continuous medium, wherein such image forming apparatus has feeding unit for conveying the continuous medium, toner image forming unit that forms a toner image on a rotating image forming drum based on image data, transfer unit that transfers to the continuous medium the toner image on the image forming drum by causing an electrostatic force to act on the image forming drum and the continuous medium at a transfer position via a transfer current, and control unit that creates the image data by adding to the picture data to be printed additional data in which black dots are dispersed in order to control the tension force applied by the image forming drum on the continuous medium.

The other feature of the image forming method according to the present invention comprises a step of creating image data by adding to the picture data to be printed additional data in which black dots are dispersed in order to control the tension force applied by the image forming drum on the continuous medium, a step of forming a toner image on a rotating image forming drum based on the image data, and a step of transferring to the continuous medium the toner image on the image forming drum by causing an electrostatic force to act on the image forming drum and the continuous medium, which is being conveyed, at a transfer position via a transfer current.

In this feature of the present invention, because an additional pattern to control the tension force is forcibly added regardless of the pattern to be printed, the generation of an excessive tension force can be prevented using a minimal amount of toner in the additional pattern. Thereby, the continuous medium can be conveyed in a stable fashion, and degradation of the print quality can be easily prevented.

DESCRIPTION OF THE PREFERRED EMBODIMENTS

Embodiments of the present invention will be explained below in the following order: Image forming apparatus, paper tension control method, first embodiment, second embodiment, third embodiment, and other embodiments.

[Image Forming Apparatus]

Figure 1:
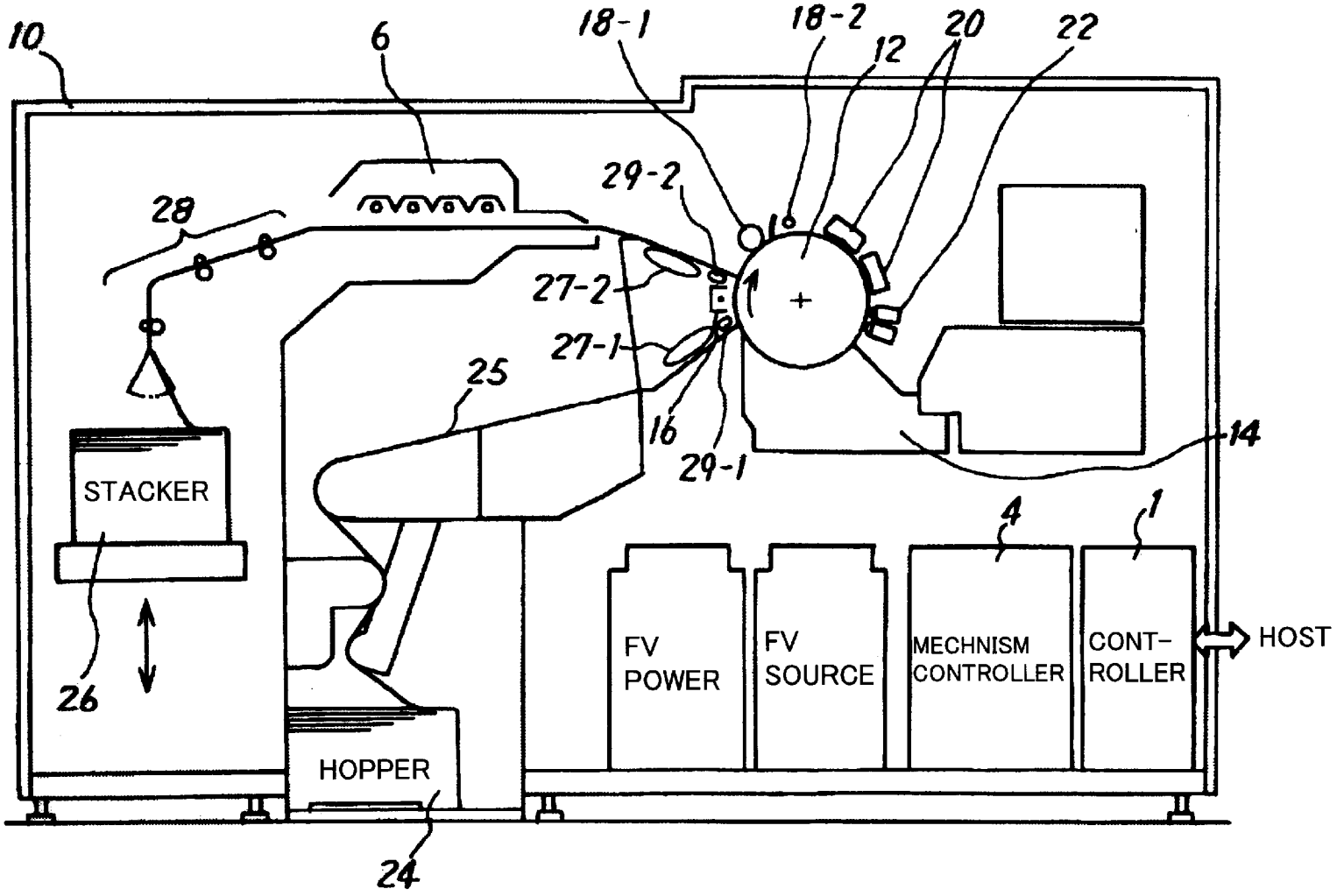
FIG. 1 is a construction diagram of the image forming apparatus pertaining to one embodiment of the present invention.
Figure 2:
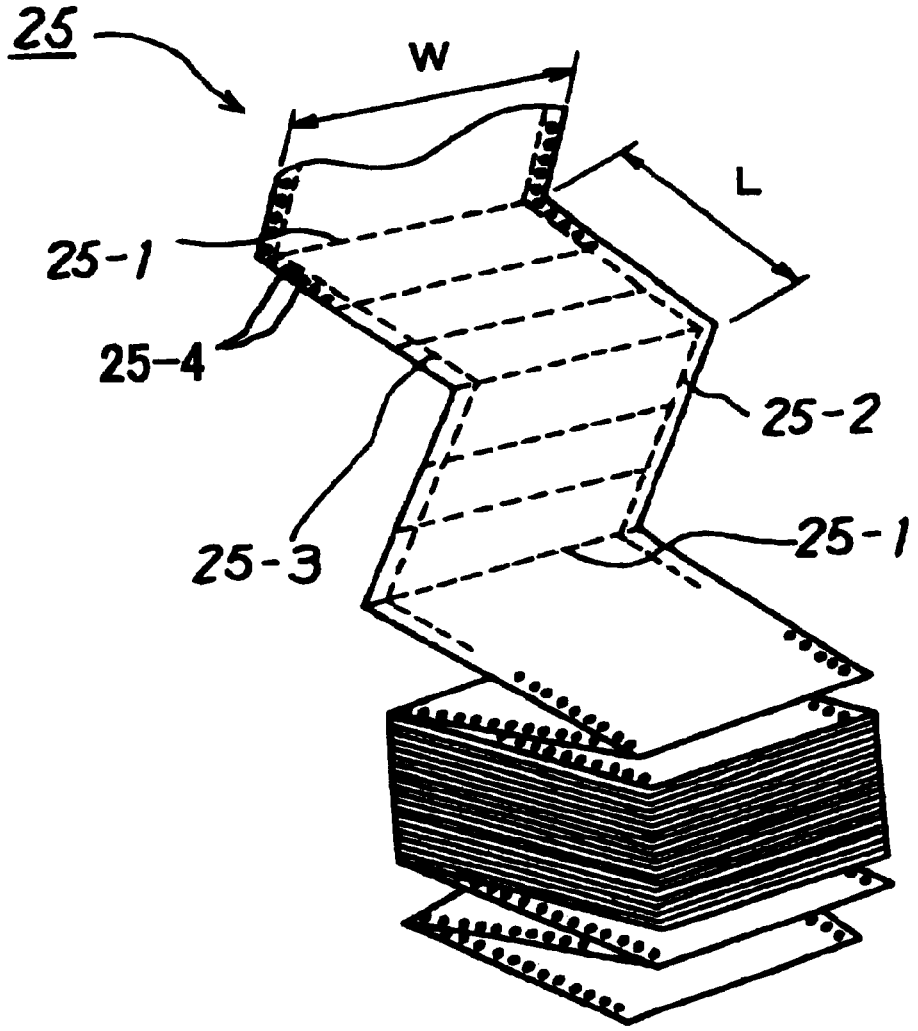
FIG. 2 is an explanatory drawing of the continuous medium shown in FIG. 1.
Figure 3:
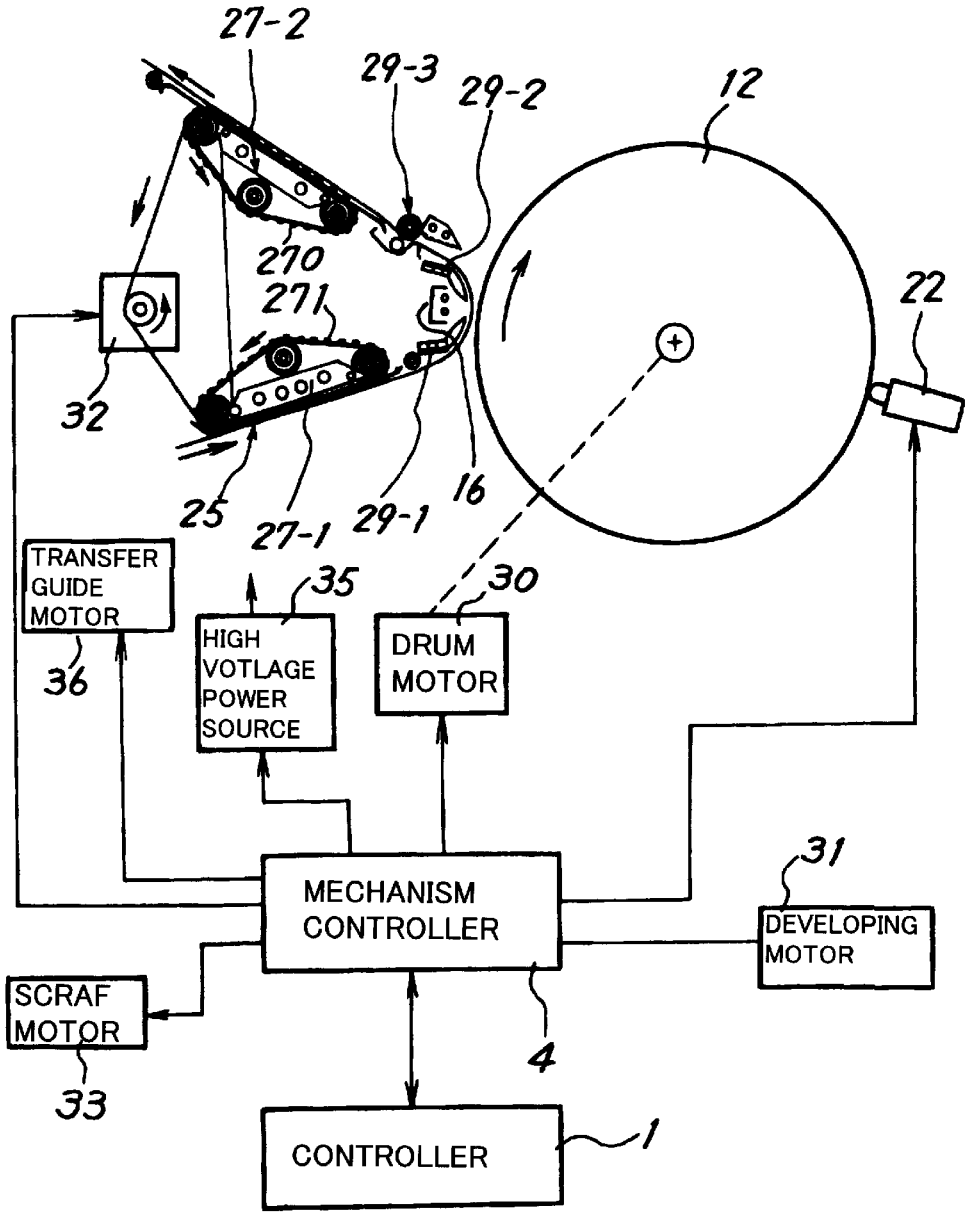
FIG. 3 is a block diagram of the main parts of the image forming apparatus shown in FIG. 1.

FIG. 1 is an overall construction diagram of the image forming apparatus pertaining to one embodiment of the present invention, FIG. 2 is an explanatory drawing of the continuous medium shown in FIG. 1, and FIG. 3 is a block diagram of the control system of the image forming apparatus in FIG. 1.

FIG. 1 shows a continuous paper page printer using the electro-photographic method as an example of an image forming apparatus. As shown in FIG. 1, the printer 10 comprises an electro-photographic mechanism. The photosensitive drum 12 is rotated in the direction of the arrow. The photosensitive drum 12 is charged by a charger 20, and then undergoes image exposure by an LED (Light Emitting Diode) head 22, which functions as an exposure unit. A latent image is thereby formed on the photosensitive drum 12. The developing unit 14 supplies a two-component developer to the photosensitive drum 12 and develops the latent image into a toner image.

A transfer unit 16, which comprises a transfer charger consisting of a non-contact type transfer unit, transfers the toner image on the photosensitive drum 12 onto the continuous paper (hereinafter 'sheet') 25. Transfer guides 29-1 and 29-2 located above and below the transfer charger 16 assist the adhesion of the sheet 25 to the photosensitive drum 12. A cleaning mechanism 18-1 eliminates the toner remaining on the photosensitive drum 12 after transfer. A discharge mechanism 18-2 electrically discharges the photosensitive drum 12 after transfer.

As shown in FIG. 2, the sheet 25 comprises continuous paper consisting of a continuous series of pages divided into page units by perforations (fold perforations or page perforations) 25-1. Sprocket holes 25-4 used for tractor conveyance are located on the left and right sides of the continuous paper 25, and left and right perforations 25-2 and 25-3 are formed in order to allow the parts containing the sprocket holes 25-4 to be detached.

The continuous paper 25 is stacked in a hopper 24. After it is guided to the transfer position by the lower (upstream) tractor 27-1, the sheet 25 in the hopper 24 is conveyed to the flash fixing unit 6 by the upper (downstream) tractor 27-2. The continuous paper 25 is further conveyed by scarf rollers 28 and housed in the stacker 26. The fixing unit 6 fixes a toner image on the sheet 25 via flash illumination.

The printer 10 is capable of performing high-speed printing at a rate of, for example, 100 pages per minute. The printer 10 includes a printer controller 1 and a mechanical controller 4. The printer controller 1 analyzes commands issued by a host not shown and generates internal commands and print data (bitmap data). The print data is developed in a bitmap memory.

The mechanical controller 4 controls the various elements 12, 14, 16, 18-2, 20 and 22 of the electrophotographic mechanism, and the various elements 27-1, 27-2 and 28 of the conveyance mechanism, in accordance with the internal commands and print data, as described below in connection with FIG. 3.

As shown in FIG. 3, the upper and lower tractors 27-1 and 27-2 have tractor belts 270 and 271 that have protrusions that engage with the sprocket holes 25-4 formed in the continuous paper 25, and are driven by the conveyance motor 32. A high-voltage power source 35 supplies transfer current to the transfer charger 16. The transfer guide motor 36 of the transfer guide mechanism performs driving to drive the transfer guides 29-1 and 29-2 located above and below the transfer charger 16. The scarf motor 33 drives the scarf rollers 28 shown in FIG. 1. The drum motor 30 causes the photosensitive drum 12 to rotate. The developing motor 31 drives the developing rollers in the developing unit 14 shown in FIG. 1 and the like.

The mechanical controller 4 performs print processing in accordance with control instructions and print data from the controller 1, controls the motors 30, 31, 32, 33, 35 and 36, and controls the charger 20, the exposure unit 22, the discharge unit 18-2 and the bias voltage of the various other devices.

The controller 1 and the mechanical controller 4 each comprise a processor, a memory and the like. The controller 1 and the mechanical controller 4 control the paper tension force applied by the photosensitive drum 12 as described below.

A pinch roller 29-3 is located between the upper tractor 27-2 and the transfer guide 29-2. It presses against the continuous paper 25 after transfer and guides it to the upper tractor 27-2. FIG. 3 shows the image forming apparatus when the transfer guides 29-1 and 29-2 are retracted.

[Paper Tension Control Method]

Figure 4:
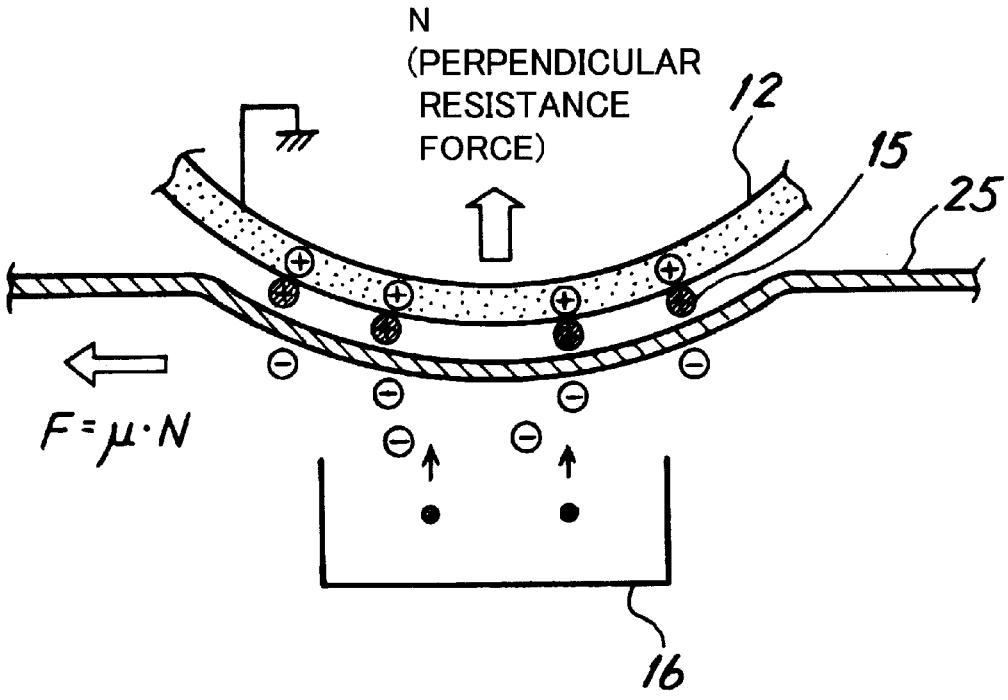
FIG. 4 is a model drawing showing the transfer area in which the tension force is controlled in the present invention.
Figure 5:
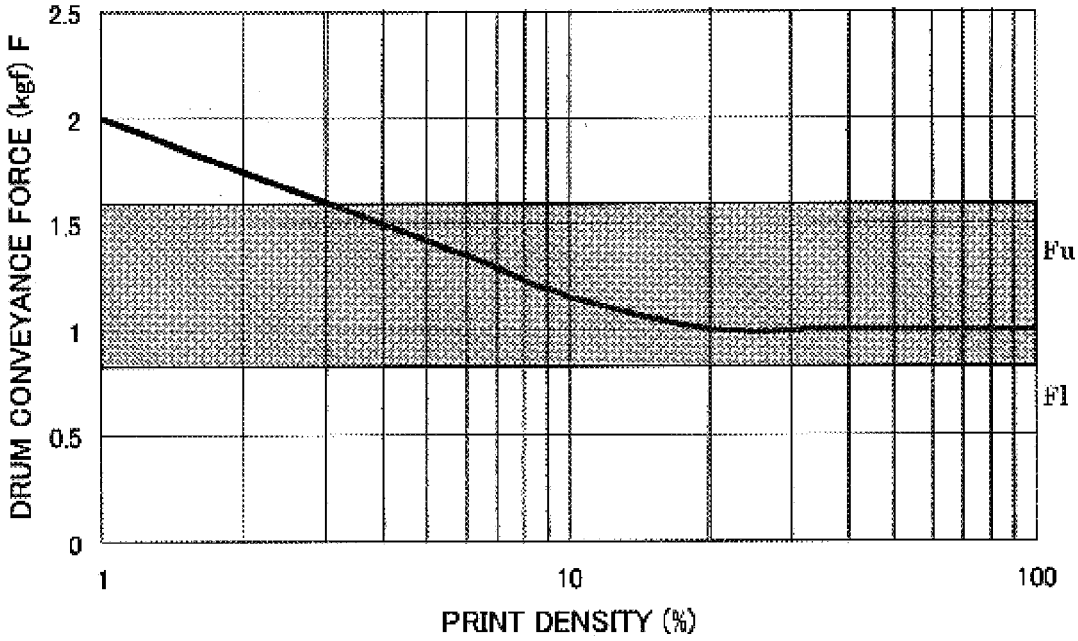
FIG. 5 is a drawing showing the relationship between the print density and the drum conveyance force (tension force)
Figure 6:
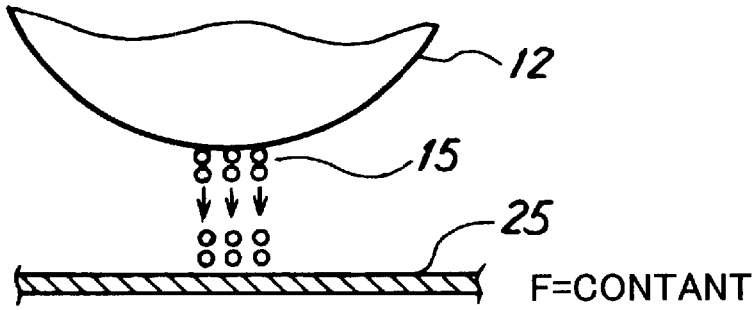
FIGS. 6(A) and 6(B) are explanatory drawings of the toner transfer operation in order to control the tension force in the present invention.
Figure 6:
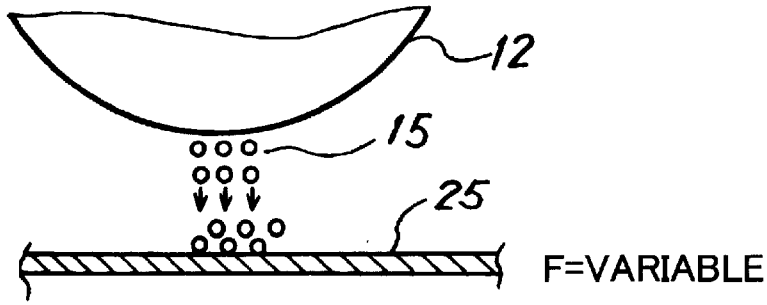
Figure 7:
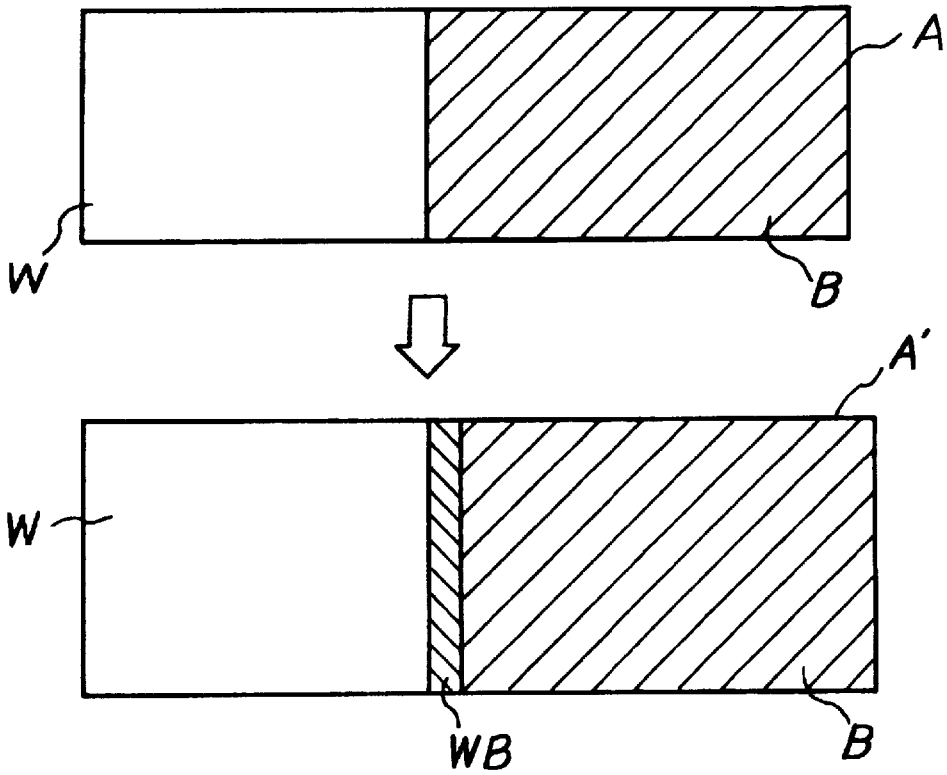
FIG. 7 is an explanatory drawing showing the effect of the toner transfer operation of FIGS. 6(A) and 6(B) on the print result.

FIG. 4 is a model drawing showing the transfer area to explain the paper tension control carried out by the present invention, FIG. 5 is a drawing showing the relationship between the print density and the drum conveyance force (paper tension force), FIG. 6 is an explanatory drawing of the toner transfer operation based on the paper tension force, and FIG. 7 is an explanatory drawing of a printed image when the paper tension fluctuates.

As shown in the model drawing of FIG. 4, in the transfer area, the photosensitive drum 12 and the continuous paper 25 are positioned such that the toner 15 on the photosensitive drum 12 resides therebetween. The toner 15 on the photosensitive drum 12 is transferred to the continuous paper 25 through the application on the backside of the continuous paper 25 by the transfer charger 16 of charge having the polarity opposite from the polarity of the charge of the toner 15.

In the transfer operation described above, in response to the charge applied to the back side of the continuous paper 25, a mirror charge having the polarity opposite from that of the charge on the back side of the continuous paper 25 is generated on the photosensitive drum 12. For example, if the transfer charge impressed to the continuous paper 25 is a negative charge, a positive mirror charge is generated on the photosensitive drum 12. The continuous paper 25 adheres to the photosensitive drum 12 as a result of the electrostatic force created by these charges.

This adhesion force acts as perpendicular resistance force N perpendicular to the direction of conveyance of the continuous paper 25, and the paper tension force (also called drum conveyance force) F expressed by the following equation is generated in the direction of conveyance of the continuous paper 25:

$$F=\mu \cdot N,$$

where $\mu$ is a coefficient of friction.

In other words, it is appreciated that the tension force F is the paper conveyance force applied by the photosensitive drum 12 in the transfer area, and is determined by the perpendicular resistance force N and the coefficient of friction $\mu$. This perpendicular resistance force N is the electrostatic force described above, and is proportional to the transfer current output from the transfer charger 16. The coefficient of friction $\mu$is influenced by the toner 15 residing between the continuous paper 25 and the photosensitive drum 12, and is proportional to the amount of such toner in particular.

FIG. 5 is a drawing showing the relationship between the printing ratio and the drum conveyance force. The printing ratio is equivalent to the amount of toner deposited within a prescribed area, and the drum conveyance force is equivalent to the tension force described above. The results shown in FIG. 5 were obtained using the printer having the construction shown in FIG. 1, in which the paper conveyance speed was set to 250 mm/sec, the drum circumference speed was set to be 0.2% faster than the paper conveyance speed. And printing was performed at a printing ratio ranging from 1% to 100%, and it is measured the drive current supplied to the drive motor 30 that drives the photosensitive drum 12 for each printing ratio and the drum conveyance force F for each printing ratio are obtained from the measured drive current.

As shown in FIG. 5, it is seen that as the printing ratio decreases, the drum conveyance force increases, and that where the printing ratio equals or exceeds 20%, the drum conveyance force is constant. This indicates that the toner amount is one factor causing fluctuations in the drum conveyance force.

At the same time, the drum conveyance force must be set within a range such that no tearing or slackening occurs in the paper. Moreover, there is also a proper range for the drum conveyance force F from the standpoint of print quality, and this proper range is shown as the darkened region in FIG. 5. This proper range is the permissible range for the blurring of characters. The printed images resulting from this tension force F are explained with reference to the transfer operation image drawings shown in FIGS. 6(A) and 6(B).

If the tension force F is constant, as shown in FIG. 6(A), the sliding degree of the continuous paper 25 on the photosensitive drum 12 is constant, and the toner image on the photosensitive drum 12 is transferred to the continuous paper 25 as is. However, at the moment the tension force F changes, as shown in FIG. 6(B), the sliding degree of the continuous paper 25 on the photosensitive drum 12, or the sliding degree of the photosensitive drum 12, changes, and the toner 15 is transferred to the continuous paper 25 with a spread.

This phenomenon is particularly noticeable where toner image A comprising a completely black area B adjacent to a completely white area W are transferred to the continuous paper 25, as shown in FIG. 7. Here, a blurry part WB appears in the transferred image A' at the top of the black area B (i.e., on the W side of the black area B). Print samples having one black line (with toner) comprising this black area B and seven white lines (without toner) were created while the drum conveyance force was varied.

The print samples at each drum conveyance force were viewed by multiple observers, and the observers' subjective determinations of the existence of print blurring were investigated. The drum conveyance force was varied by changing the transfer current, in accordance with the relationship equation provided above and as described below.

The results of the above investigation demonstrated that the darkened range Fu-Fl shown in FIG. 5, equivalent to a range between 0.8 kgf and 1.6 kgf under the conditions described above, was a good range in which the observers did not recognize print blurring. From FIG. 5, it is also understood that the printing ratio of 3% or higher is favorable. Furthermore, if the drum conveyance force F exceeds 2.5 kgf, the paper begins to tear.

Considering the fact that the drum conveyance force (tension force) F changes in accordance with the printing ratio, and that a proper range exists for the drum conveyance force F from the standpoint of preventing paper tearing and preserving print quality, the present invention performs control to maintain the drum conveyance force within this proper range.

Figure 8:
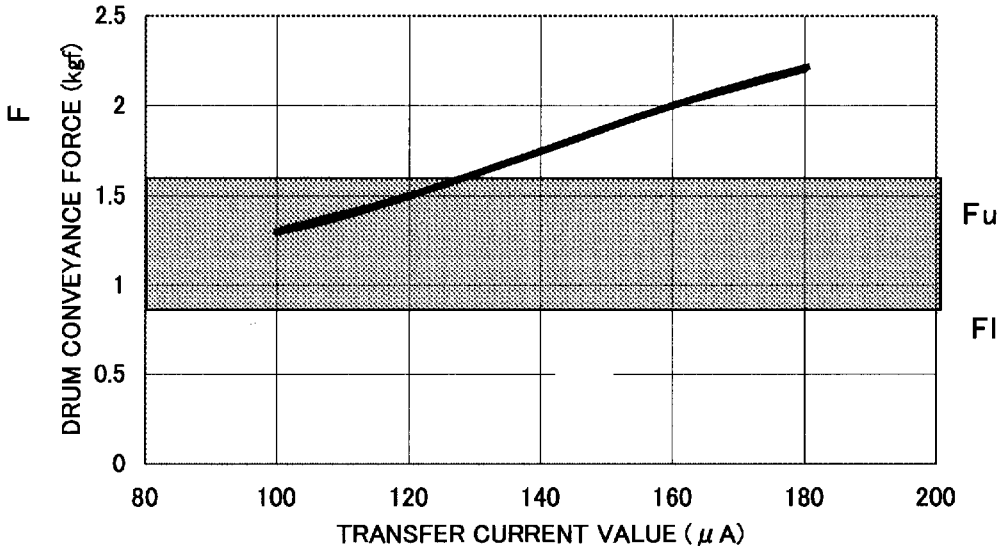
FIG. 8 is a drawing showing the relationship between the transfer current and the drum conveyance force (tension force)

Based on the relationship equation described above, the drum conveyance force (tension force) F can be controlled using the coefficient of friction $\mu$ corresponding to the toner amount (printing ratio) and the perpendicular resistance force N corresponding to the transfer current. First, the perpendicular resistance force N is proportional to the transfer current. FIG. 8 is a drawing showing the relationship between the transfer current and the drum conveyance force F in the printer described above under the conditions described above. In other words, FIG. 8 indicates the results of measurement of the drum conveyance force F when the print samples described above were printed while the transfer current from the transfer charger 16 was varied from 80 $\mu$A to 200 $\mu$A.

From FIG. 8, it can be seen that as the transfer current value increases, the drum conveyance force F increases as well. In other words, the drum conveyance force F (perpendicular resistance force N) can be controlled via the transfer current value. It is further understood that in order to maintain the drum conveyance force F within the proper range Fu-F1, the transfer current value must not exceed 130 $\mu$A.

Therefore, by measuring the printing ratio shown in FIG. 5 and controlling the transfer current in accordance with the measured printing ratio, the drum conveyance force (paper tension force) can be controlled within the proper range. In other words, the transfer current is controlled while the drum conveyance force is monitored via the variable factor of the printing ratio, and the drum conveyance force is controlled within the proper range via feedback control. Specifically, where the printing ratio is low, the transfer current value is reduced in order to reduce the drum conveyance force. In this way, even where the transfer current value is reduced, because the printing ratio is low (i.e., because there is little toner), the effect on transfer efficiency is minimal, and good transfer results are obtained.

Figure 9:
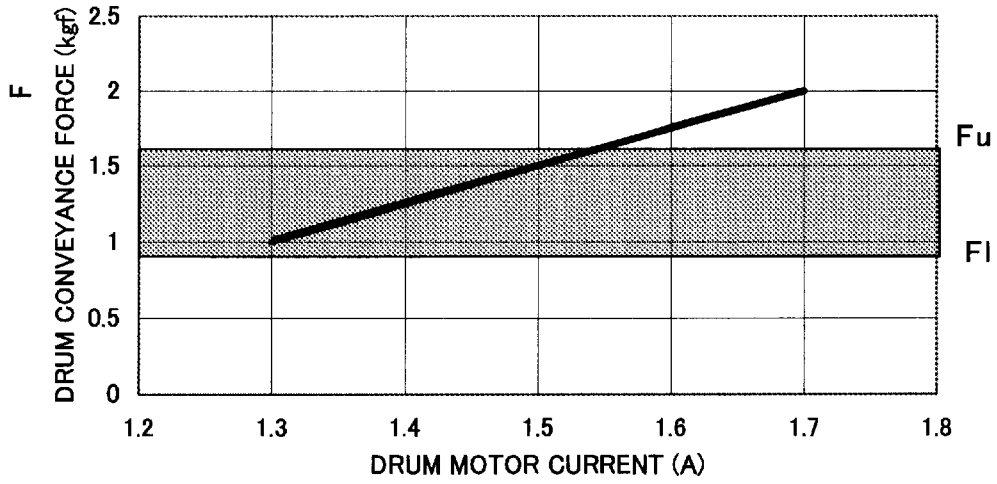
FIG. 9 is a drawing showing the relationship between the drum motor current and the drum conveyance force (tension force)

The motor current of the drum motor 30 can be used in order to monitor the drum conveyance force. FIG. 9 is a drawing showing the relationship between the value of the motor current supplied to the drum motor 30 of the photosensitive drum and the drum conveyance force of the photosensitive drum when the photosensitive drum 12 is controlled to rotate at a fixed speed. Where the drum motor 30 is a DC motor, the current flowing to the drum motor can be converted to drum conveyance force (paper tension) F using a torque constant.

Therefore, by measuring drum current value and controlling the transfer current in accordance with the measured drum current value, the drum conveyance force (paper tension force) is controlled within the proper range. In other words, the transfer current is controlled while the drum conveyance force is monitored via the variable factor of the drum current value, and the drum conveyance force is controlled within the proper range via feedback control. Specifically, where the drum current value exceeds a certain value, the transfer current value is reduced in order to reduce the drum conveyance force. In this way, even where the transfer current value is reduced, where the drum current value is large, because the printing ratio is low (i.e., because there is little toner), the effect on transfer efficiency is minimal, and good transfer results are obtained.

In addition, a separate method exists in which the printing ratio is prevented from falling to or below a prescribed value, based on the relationship equation described above or the relationship shown in FIG. 5. In other words, a low-printing ratio pattern is forcibly written into the white spaces in which there is no print data. For example, by writing into the bit map data to be printed a pattern comprising diffused black dots that have no effect on the image content, toner particles are caused to adhere in areas having no print data, thereby preventing the occurrence of excessive drum conveyance force and maintaining an appropriate drum conveyance force.

In this case, if the resolution is a low resolution of approximately 240 dpi, there is a risk that the content of the image may be affected, but if the resolution is a relatively high resolution of approximately 1200 dpi, there is no noticeable effect on the output image even after an appropriate diffuse pattern is overlaid, and therefore degradation of the image quality can be prevented.

[First Embodiment]

Figure 10:
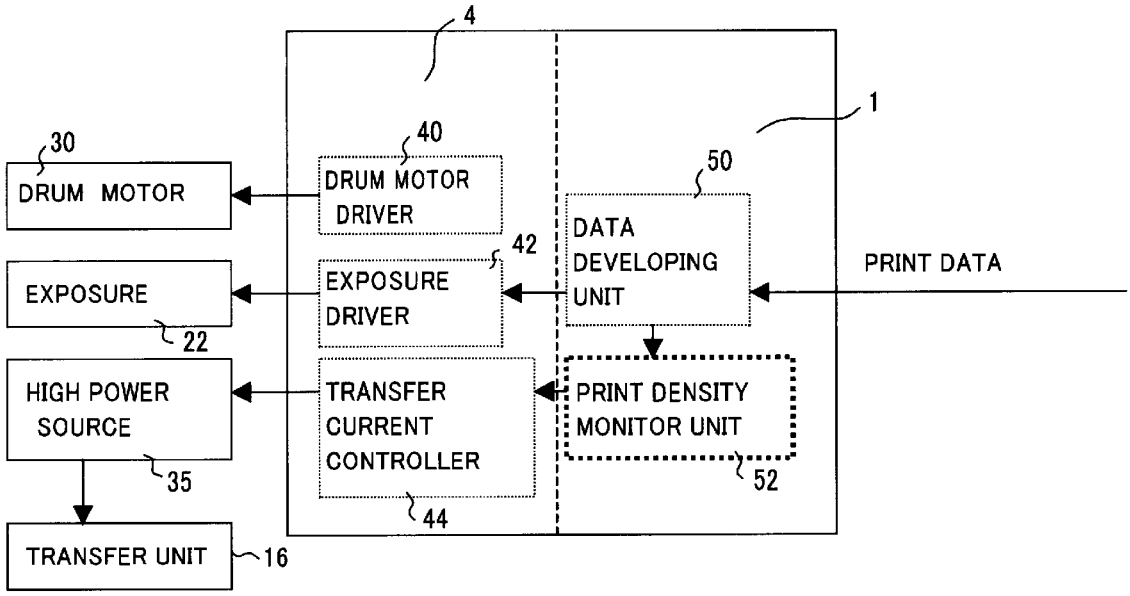
FIG. 10 is a block diagram of the control system in the first embodiment of the present invention.
Figure 11:
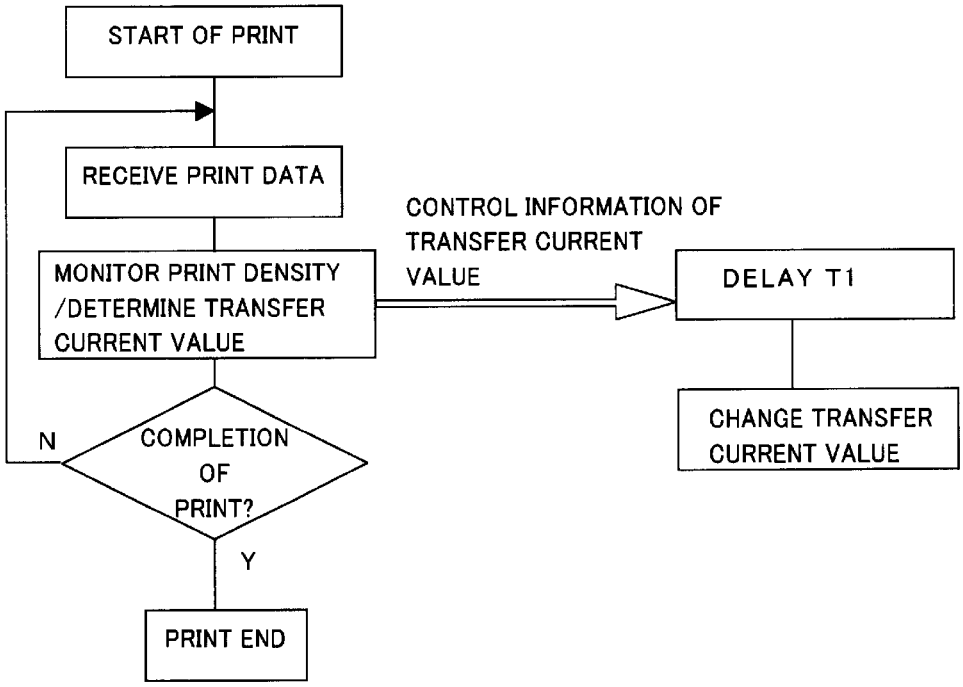
FIG. 11 is a flow chart of the control sequence pertaining to the first embodiment of the present invention.

FIG. 10 is a block diagram of a first embodiment of the present invention, while FIG. 11 is a flow chart of the transfer current control process pertaining thereto.

FIG. 10 shows only the parts in the controller 1 and the mechanical controller 4 comprising the control unit that pertain to the present invention. When print data is input to the controller 1, the data developing unit 50 develops the data into bitmap image data. The developed bitmap data is sent one line at a time to the optical driver 42 of the mechanical controller 4. The driver 42 drives the optical exposure unit (LED array) 22, thereby a latent image is formed on the photosensitive drum 12.

The drum motor 30 of the photosensitive drum 12 is driven to rotate by the drum motor driver 40 of the mechanical controller 4. The transfer current output by the transfer unit (transfer charger) 16 is supplied from the high-voltage power source 35 controlled by the transfer current controller 44 of the mechanical controller 4.

The print density monitoring unit 52 receives bitmap data from the data developing unit 50, calculates the printing ratio, and determines the transfer current value corresponding to this printing ratio, in accordance with the processing sequence shown in FIG. 11. The print density monitoring unit 52 sends the transfer current value to the transfer current controller 44 after a prescribed delay interval, and the transfer current controller 44 controls the value of the transfer current output from the high-voltage power source 35 to the transfer unit 16.

It is preferred that during the monitoring of the printing ratio, one page of the continuous paper 25 be divided into multiple regions along the direction of conveyance, for example, and that measurement take place for each region. For example, using this method, one page is divided into 10 regions or into regions 20 mm wide, measurement takes place in each region, and the transfer current value is determined for each region.

The delay interval shown in FIG. 11 is set as the period during which the developed bitmap data is converted into a toner image via exposure and development and reaches the transfer unit. In this way, the transfer current value can be varied in accordance with the printing ratio at the moment that the toner image corresponding to the bitmap data is transferred, enabling synchronous control.

Figure 12:
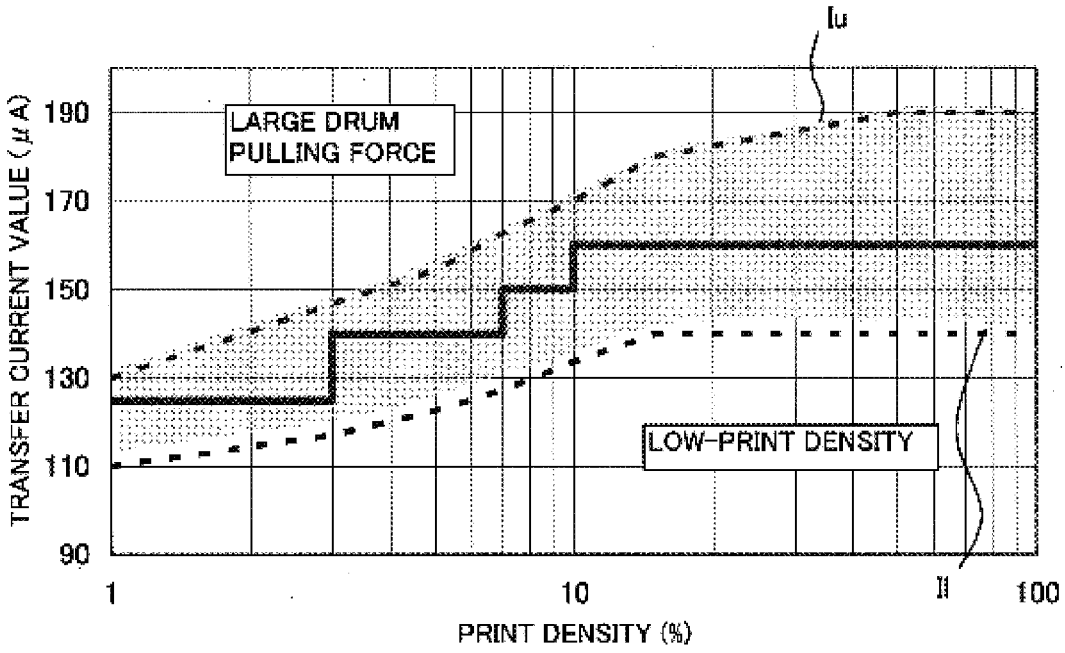
FIG. 12 is an explanatory drawing showing the transfer current switching control performed in the first embodiment of the present invention.

FIG. 12 is a drawing showing one example of the relationship between the print density (printing ratio) and the transfer current value, which is employed to control the alternation of the transfer current. The transfer current value is determined from the monitored printing ratio according to the relationship shown in this drawing. FIG. 12 shows an example in which the transfer current is varied in four stages in accordance with the print density (%), based on the relationship shown in FIG. 5 between the print density (%) and the drum conveyance force and the relationship shown in FIG. 8 between the transfer current value and the drum conveyance force.

The dashed line Iu at the top of FIG. 12 corresponds to the upper limit Fu of the drum conveyance force F, the dashed line Il at the bottom of FIG. 12 corresponds to the lower limit Fl of the drum conveyance force F, and the range between these two dashed lines is the proper range for the drum conveyance force F. The relationship between the print density and the transfer current value is set in the center of this proper range, as indicated by the solid line.

Figure 13:
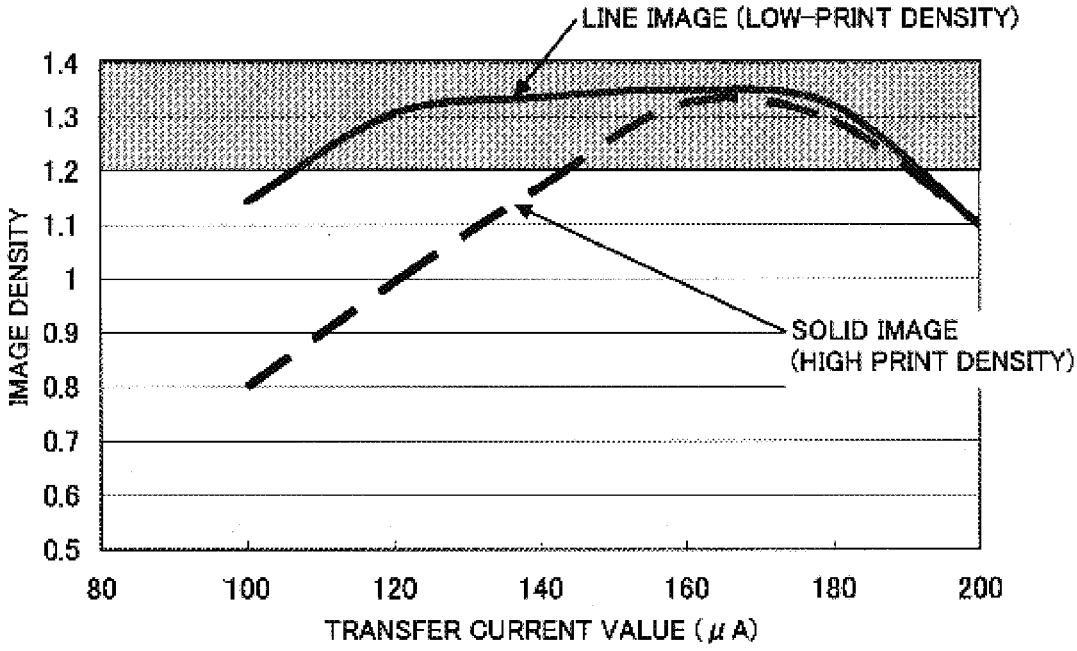
FIG. 13 is a drawing showing the relationship between the transfer current and the image density in the first embodiment of the present invention.

The relationship between the transfer current value and the image density will now be explained. FIG. 13 is a drawing showing the relationship between the transfer current and the image density, FIG. 14 is an explanatory drawing of the development operation, FIG. 15 is an explanatory drawing showing electric flux lines, and FIG. 16 is an explanatory drawing of the edge effect during development.

Figure 14:
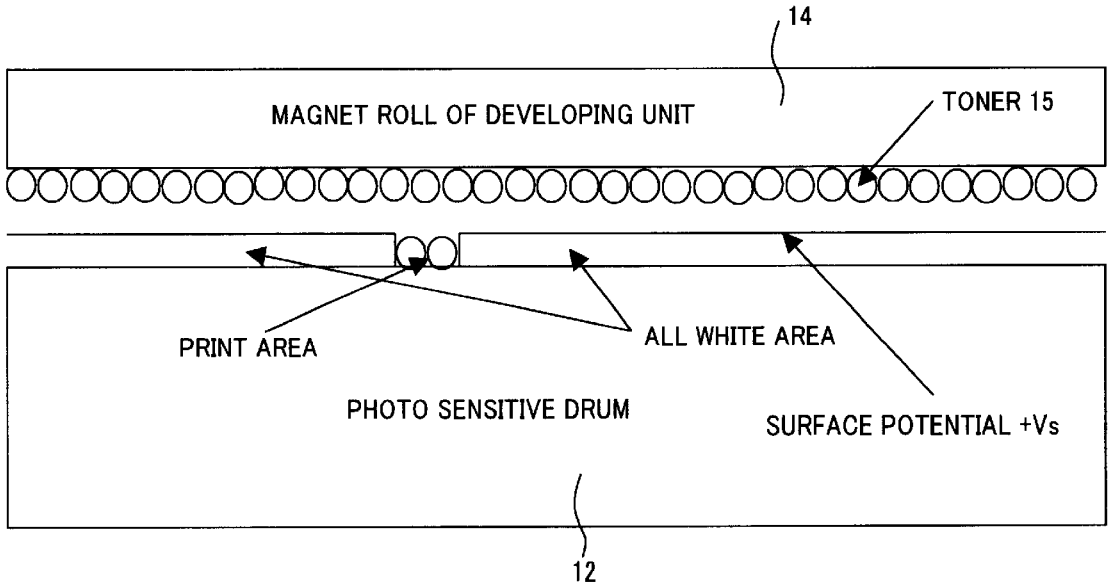
FIG. 14 is an explanatory drawing showing the development operation performed in the first embodiment of the present invention.

As shown in FIG. 14, a latent image is formed on the photosensitive drum 12 via electrostatic force using the electro-photographic process known in the art. The areas having a high surface potential are the solid white areas, and the parts having a lower surface potential are print areas (black dot areas). The toner 15 supplied via the magnet roll of the developing unit 14 electrostatic adheres through electric force to only the print areas having a lower surface potential.

Figure 15:
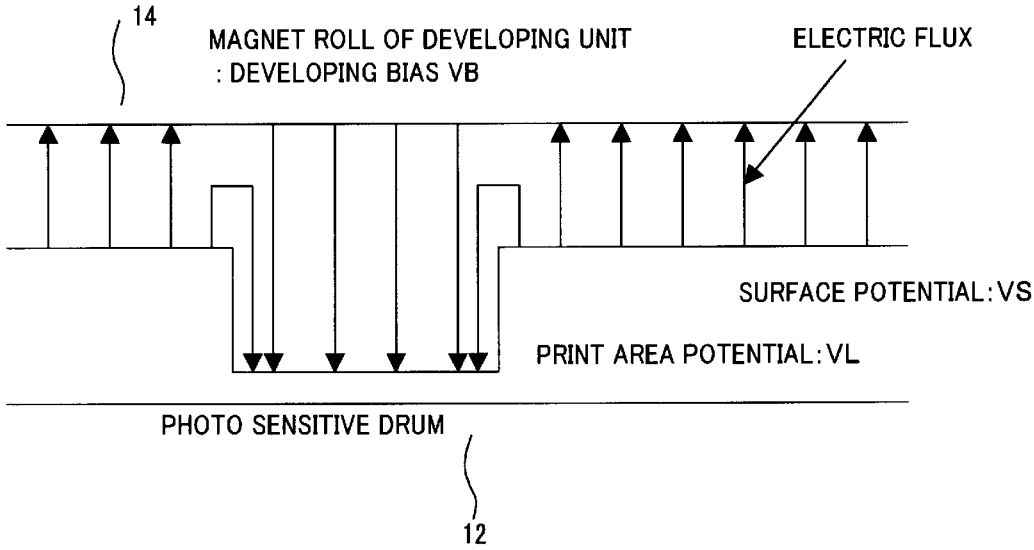
FIG. 15 is an explanatory drawing of the electric flux lines in the developing unit shown in FIG. 14.
Figure 16:
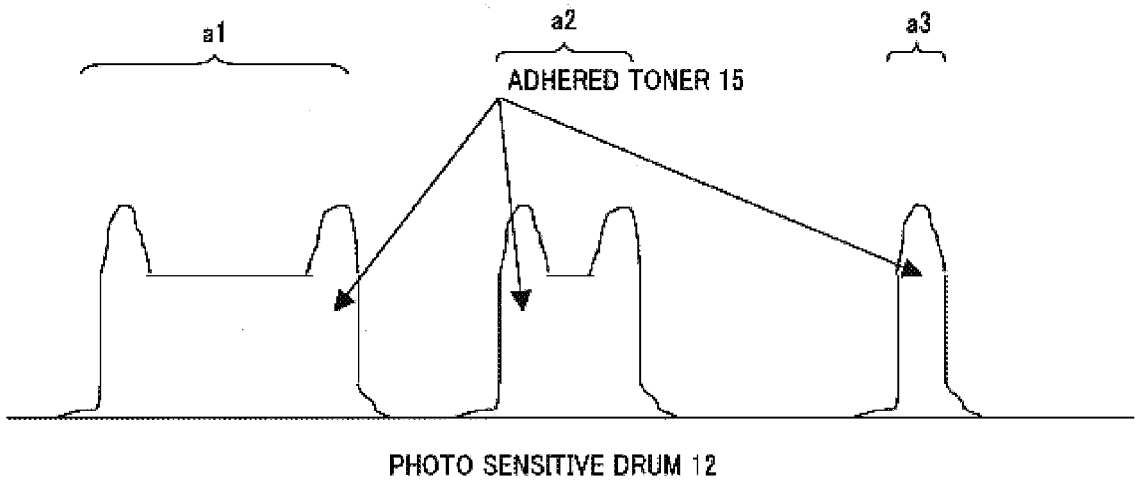
FIG. 16 is an explanatory drawing showing the adhesion of toner to the photosensitive drum shown in FIG. 14.

FIG. 15 is an expanded view of the print area of FIG. 14 in which the electric potential and electric flux lines are shown. In FIG. 15, the surface potential at the solid white areas of the photosensitive drum 12 is deemed VS(+), and the voltage VB is applied to the magnet roll of the developing unit 14 as a developing bias. VB is set to a value lower than VS. Therefore, the electric flux lines for the solid white areas rise in the drawing, and run toward the developing unit 14.

Assuming that the toner 15 has a positive charge, the toner 15 receives force in the direction of the electric lines of flux, so that in the solid white areas, the toner 15 does not migrate toward the drum, thereby the toner does not adhere on the surface of the drum 12.

In the print areas, on the other hand, the surface potential of the drum 12 falls to the level VL as a result of exposure by the optical system. Because VL falls to a value lower than VB, the electric flux lines for the print areas run downward in the drawing, opposite the direction of the electric flux lines for the solid white areas. Because the positively charged toner migrates along the electric flux lines, the toner 15 adheres to the drum 12 in the print areas.

Incidentally, in the border between the solid white areas and the print areas, because as a practical matter VL is lower than VS, it is occurred that the electric flux lines turns to the print areas from the solid white areas, which is shown in the drawing. As a result, the density of the electric flux lines increases in the border areas, and a larger quantity of toner 15 adheres to the drum 12. This phenomenon is referred to as the edge effect.

FIG. 16 is an explanatory drawing of the amount of toner adhering to the drum 12. The curve a1 in FIG. 16 indicates a solid image having a relatively large area and a high print density. In this case, the edge effect occurs at the edges of the image, and the amount of toner adhering in the edge areas is greater than the amount of toner adhering in the central areas. The curve a2 indicates a slightly smaller solid area in which the toner amount is equally high in the areas where the edge effect occurs, but because the solid area is slightly smaller, the average toner amount overall is larger than in the image indicated by the curve al. In the case of the line image indicated by the curve a3 (which has a low print density), the amount of adhering toner in all line image areas is large due to the edge effect.

Therefore, due to variations in the average amount of toner adhering to the photosensitive drum 12, the optimal transfer current value is different for solid images and line images. FIG. 13 is a drawing showing the relationship between the transfer current value and the image density.

As shown by the dashed line in FIG. 13, in the solid images having a high print density, the prescribed image density is not achieved unless the transfer current is increased to a certain level. If the transfer current is increased to an excessively high level, because conversely the current that leaks from the paper to the drum becomes large and the image density declines, the proper value range is essentially the darkened region of FIG. 13.

However, in the case of a line image having a low print density, because the average amount of toner adhering to the drum is high due to the edge effect described above, it is seen that the proper range for the transfer current widens downward.

Accordingly, in the present invention, where the print density is low, the transfer current is controlled downward, but there is almost no degradation of print quality. The areas having a low print density in FIG. 12 are areas in which the transfer current is too low and the prescribed print density is not obtained. As the print density falls, sufficient print density can be obtained even with a low transfer current, for the reasons described above. On the other hand, the regions with a high drum pulling force are areas in which conveyance is unstable due to an excessive transfer current. As the print density falls, problems easily arise even where the transfer current is low. The solid line in FIG. 12 is an example of changes in the transfer current carried out in accordance with the print density. In this case, the transfer current is changed in four stages.

[Second Embodiment]

The control performed to switch the transfer current based on the drum motor current value, which comprises a second embodiment of the present invention, will be explained with reference to FIGS. 17 through 19. FIG. 18 is a block diagram showing only the parts of the controller 1 and the mechanical controller 4 comprising the control unit that pertain to the present invention, and FIG. 19 is a flow chart of the control process.

When print data is input to the controller 1, the data developing unit 50 develops the data into bitmap image data. The developed bitmap data is sent one line at a time to the optical driver 42 of the mechanical controller 4. The driver 42 drives the optical exposure unit (LED array) 22, thereby a latent image is formed on the photosensitive drum 12.

The drum motor 30 of the photosensitive drum 12 is driven to rotate by the drum motor driver 40 of the mechanical controller 4. In order to perform constant-speed control of the photosensitive drum 12, the drum motor driver 40 controls the drum motor current value using the output from the encoder of the photosensitive drum 12 as feedback input. The transfer current output by the transfer unit (transfer charger) 16 is supplied from the high-voltage power source 35 controlled by the transfer current controller 44 of the mechanical controller 4.

Figure 19:
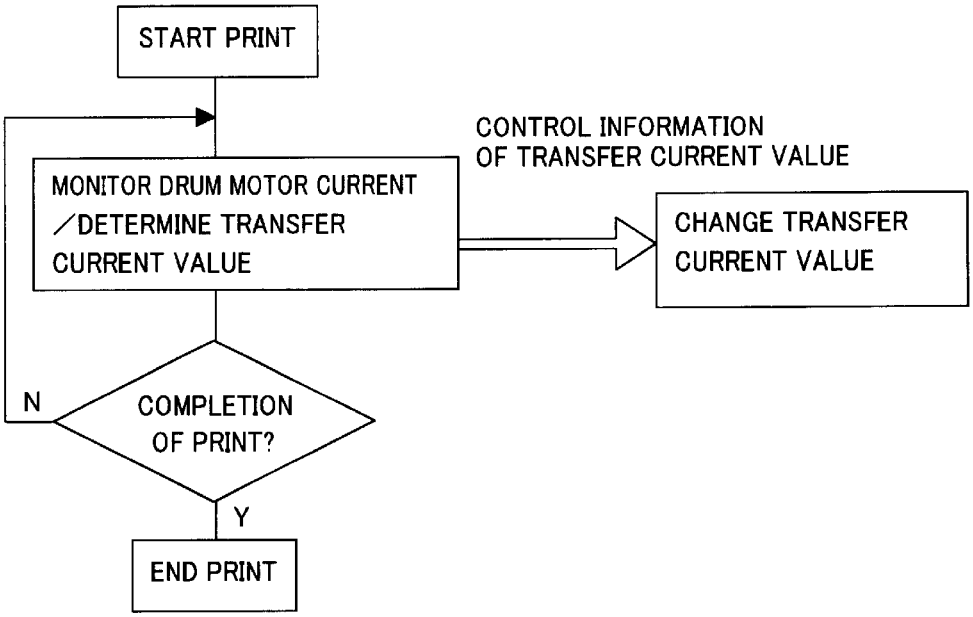
FIG. 19 is a flow chart of the control sequence pertaining to the second embodiment of the present invention.

The drum current monitoring unit 46 monitors the value of the drum motor current supplied from the drum motor driver 40 and determines the transfer current value corresponding to this motor current value, in accordance with the processing sequence shown in FIG. 19. The drum current monitoring unit 46 sends the transfer current value to the transfer current controller 44 in real time, and the transfer current controller 44 controls the value of the transfer current output from the high-voltage power source 35 to the transfer unit 16. It is preferred that this drum current monitoring be performed in real time.

Figure 17:
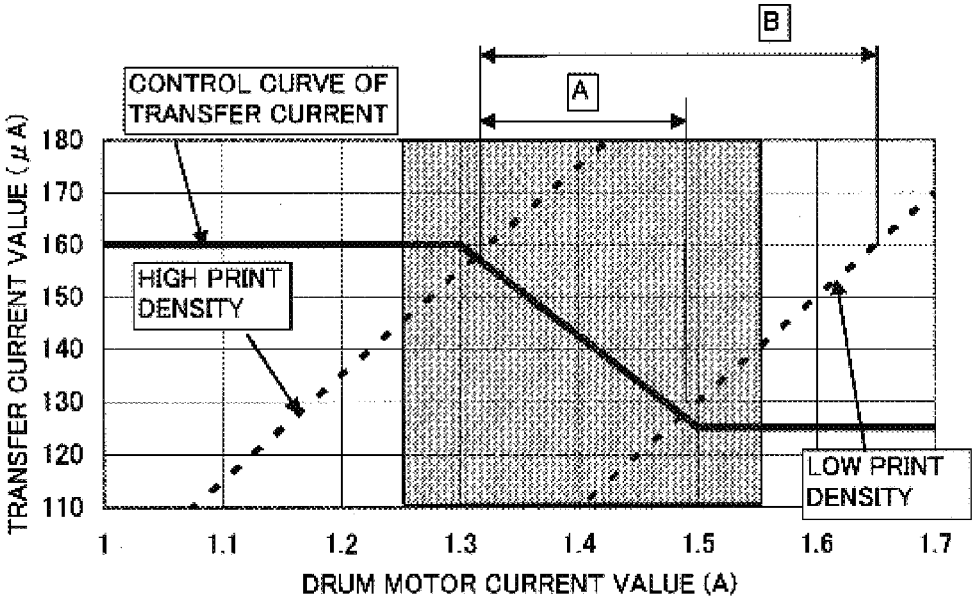
FIG. 17 is a drawing showing the relationship between the transfer current and the drum motor current in the second embodiment of the present invention.
Figure 18:
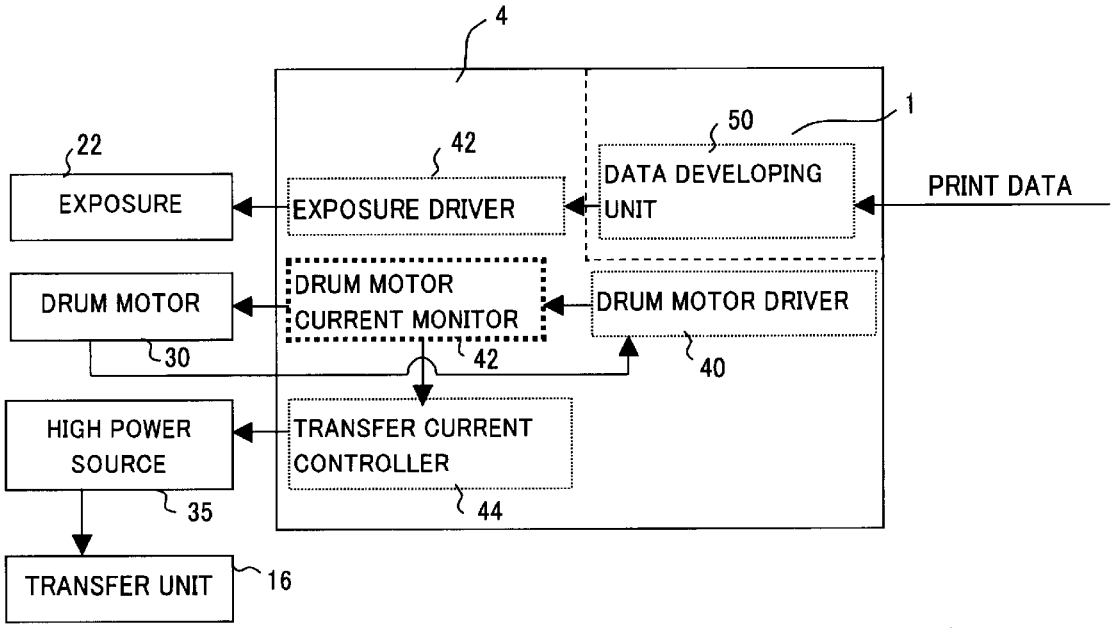
FIG. 18 is a block diagram of the control system in the second embodiment of the present invention.

FIG. 17 is a drawing showing the relationship between the drum motor current value and the transfer current value. In the drawing, the solid line is a control curve of the transfer current based on the drum motor current supplied to the drum motor of the second embodiment of the present invention. When the drum motor current reaches a high level, the transfer current is controlled downward. On the other hand, the dashed lines show the relationship between the transfer current and the drum motor current (drum conveyance force) when the printing ratio is fixed. Because the drum conveyance force rises when the transfer current is increased, the drum motor current also increases.

Where the printing ratio is changed, the dashed lines in FIG. 17 shift vertically. Because a low printing ratio results in a larger drum conveyance force when the transfer current is constant, the dashed lines move downward when the printing ratio is reduced.

Where this type of control is used, the stable points during actual control are the points of intersection between the solid line and the dashed lines. In other words, in the case of a high printing ratio, the transfer current is controlled to be slightly lower than 160 $\mu$A, and the drum motor current is slightly higher than 1.3A. When the printing ratio is changed to a low printing ratio, the transfer current is controlled to be slightly lower than 130 $\mu$A and the drum motor current is slightly lower than 1.5A. The darkened region in FIG. 17 is the optimal drum motor current value with respect to the drum conveyance force.

When the control process of this embodiment is used, a proper drum conveyance force can be maintained even when the printing ratio changes because the range of fluctuation of the drum motor current falls within the region A in FIG. 17. On the other hand, where this embodiment is not adopted, for example, where the transfer current value is maintained at the fixed level of 160 $\mu$A, because the range of fluctuation of the drum motor current caused by changes in the printing ratio fall within the range B shown in FIG. 17, the drum conveyance force exceeds the proper range.

[Third Embodiment]

Figure 20:
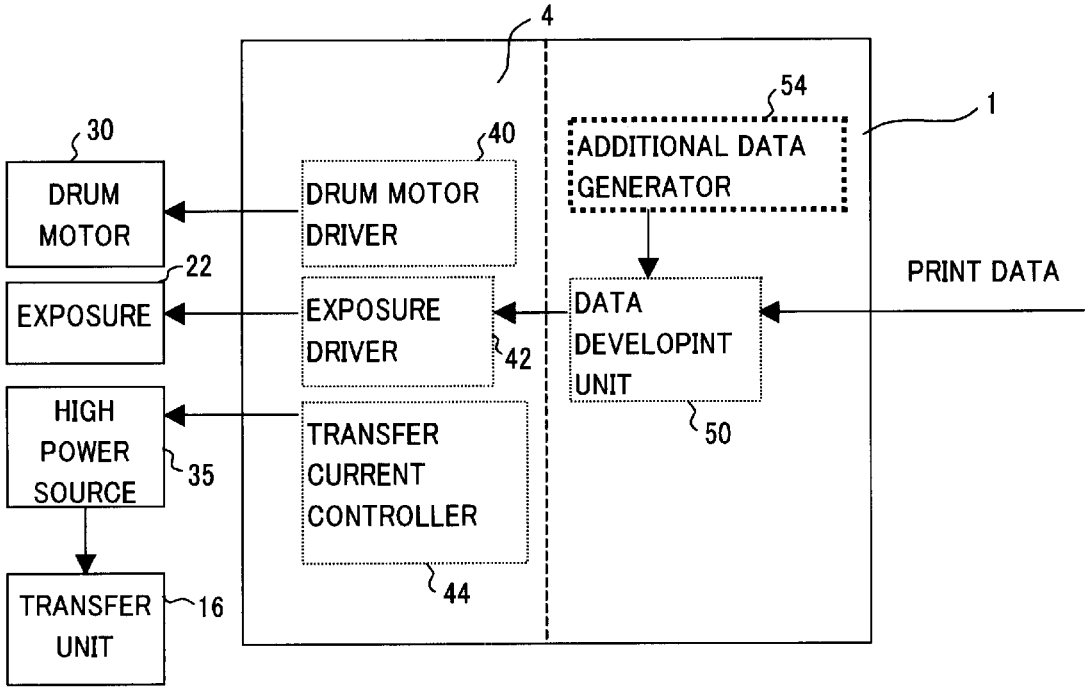
FIG. 20 is a block diagram of the control system in the third embodiment of the present invention.
Figure 21:
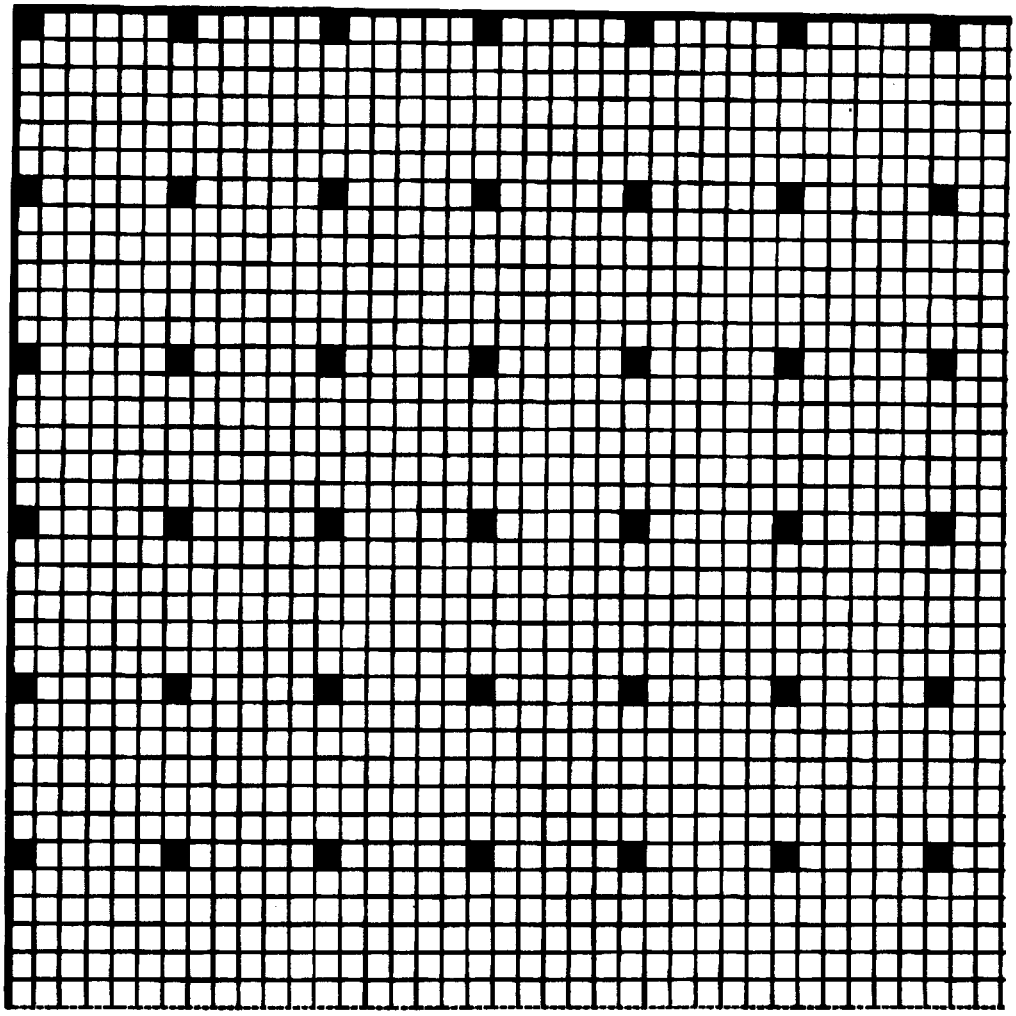
FIG. 21 is an explanatory drawing of the additional pattern used in the third embodiment of the present invention.
Figure 22:
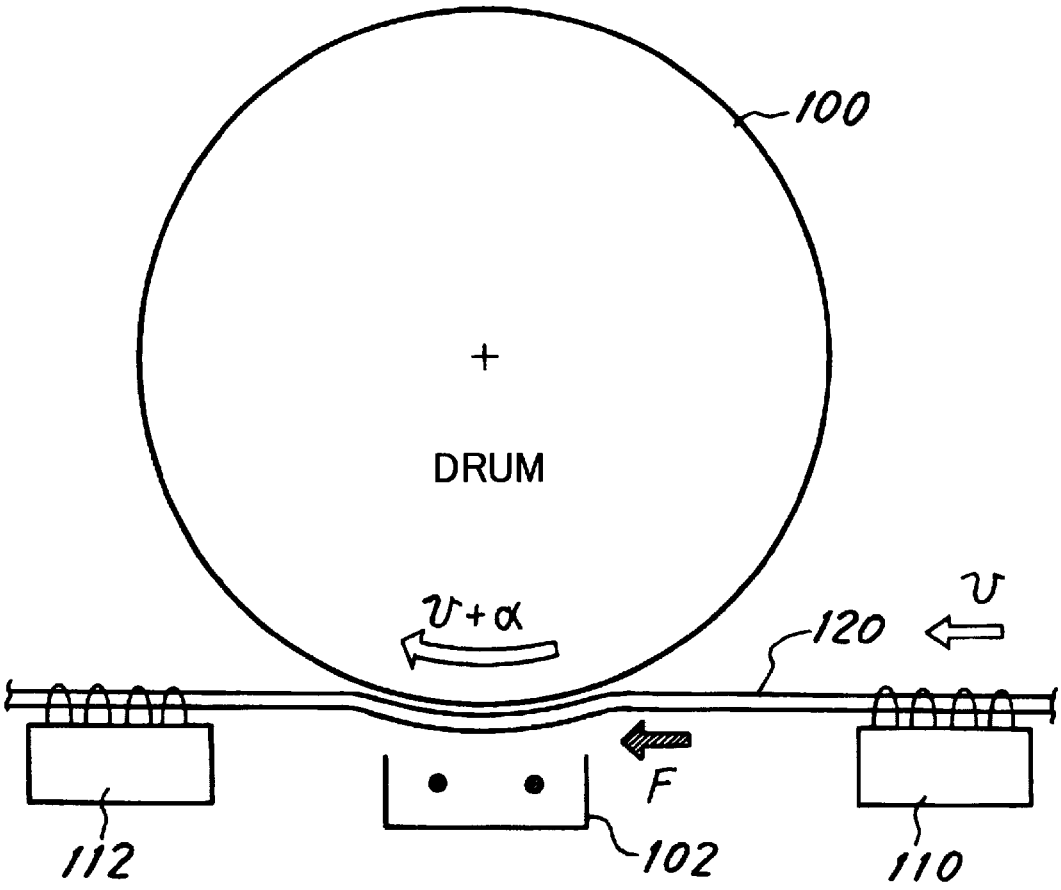
FIG. 22 PRIOR ART
FIG. 22 is an explanatory drawing of the conventional art.
Figure 23:
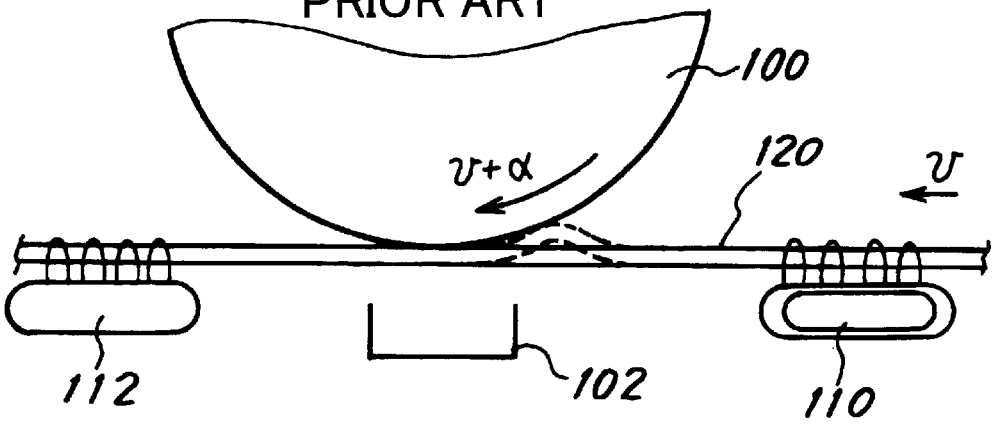
FIG. 23 PRIOR ART
FIG. 23 is an explanatory drawing showing problems with the conventional art.

The control of the drum conveyance force carried out through forcible control of the toner amount, which comprises a third embodiment of the present invention, will now be explained with reference to FIGS. 20 and 21. FIG. 20 is a block diagram showing only the parts of the controller 1 and the mechanical controller 4 comprising the control unit that pertain to the present inventions and FIG. 21 is an explanatory drawing of an additional pattern.

When print data is input to the controller 1, the data developing unit 50 develops the data into bitmap image data in a bitmap memory. The developed bitmap data is sent one line at a time to the optical driver 42 of the mechanical controller 4. The driver 42 drives the optical exposure unit (LED array) 22, thereby a latent image is formed on the photosensitive drum 12.

The drum motor 30 of the photosensitive drum 12 is driven to rotate by the drum motor driver 40 of the mechanical controller 4. The transfer current output by the transfer unit (transfer charger) 16 is supplied from the high-voltage power source 35 controlled by the transfer current controller 44 of the mechanical controller 4.

The additional data generator 54 of the controller 1 generates a diffuse pattern having a low printing ratio and writes the pattern into the bitmap memory as an overlay image. For example, a dot pattern comprising one black dot in a 6×6 matrix, as shown in FIG. 21, is effective.

Because this additional pattern has a print density of approximately 2.8% even where the print density is otherwise 0% (i.e., a solid white area), the drum conveyance force can be maintained in essentially the proper range (for example, the range shown in FIG. 5). Because it is essential that this additional pattern be arranged such that it is not noticeable in the print image, it is preferred that the additional pattern be a pattern in which black dots are diffused, as shown in FIG. 21, and a pattern that increases the printing ratio to the point that the drum conveyance force falls within the proper range is preferred.

Where excessive toner fog occurs on the photosensitive drum 12, the drum conveyance force can be prevented from becoming excessively large, but because the amount of excessive toner fog changes due to deterioration of the developer and cannot be controlled, the drum conveyance force cannot be controlled within the proper range based on the excessive toner fog.

[Other Embodiments]

While the continuous medium described in connection with the above embodiments comprised tractor-fed folded continuous paper with perforation holes, the present invention may also be applied using a continuous medium conveyed by a roller or a continuous medium that can be conveyed by a different type of conveyance means.

Furthermore, while a transfer charger was employed as the transfer unit, the present invention may also be applied using a different non-contact type transfer unit or a contact-type transfer unit such as a transfer roller. In addition, while a photosensitive drum was employed as the image forming drum, the present invention may also be applied using a different type of image forming drum such as an intermediate transfer drum.

While the present invention was described above with reference to embodiments, variations of the present invention within the essential scope thereof are included therein, and such variations are not excluded from the scope of the present invention.

As described above, according to the present invention, the following effects are achieved.

Because the tension force applied by the image forming drum to the continuous medium via electrostatic force applied by the transfer unit to transfer a toner image onto the continuous medium from the image forming drum is controlled, the tension force can be maintained at a proper level, the continuous medium is conveyed in a stable fashion, and good printing results can be obtained.

Furthermore, because the tension force is monitored and controlled based on the printing ratio or the drum motor current, the tension force can be controlled within a proper range. Moreover, because additional data that controls the tension force and does not cause image degradation is added to the print data, the tension force is controlled within a proper range by the toner formed on the image forming drum.

What is claimed is:

1. An image forming apparatus that forms a toner image on a continuous medium, comprising:

feeding means for feeding said continuous medium;

toner image forming means for forming a toner image on a rotating image forming drum;

transfer means for transferring, to said continuous medium, the toner image on said image forming drum by causing an electrostatic force to act on said image forming drum and said continuous medium at a transfer position via a transfer current; and control means for monitoring a tension force applied by said image forming drum on said continuous medium and controlling a value of said transfer current of said transfer means in accordance with the results of said monitoring.

2. The image forming apparatus according to claim 1, wherein said control means monitors a printing ratio from print data used to form said toner image on said image forming drum, and controls the value of said transfer current of said transfer means based on the results of said monitoring.

3. The image forming apparatus according to claim 2, wherein said control means performs control to reduce said transfer current value when said printing ratio is low and increase said transfer current value when said printing ratio is high.

4. The image forming apparatus according to claim 2, wherein said control means controls said transfer current value in accordance with the results of said monitoring of the printing ratio after a prescribed delay interval following the point in time at which said monitoring is performed.

5. The image forming apparatus according to claim 1, wherein said control means monitors the current supplied to a motor for rotating said image forming drum and controls the value of said transfer current of said transfer means based on the results of said monitoring.

6. The image forming apparatus according to claim 5, wherein said control means performs control to reduce said transfer current value when said motor current value is large and increase said transfer current value when said motor current value is small.

7. The image forming apparatus according to claim 1, wherein based on the results of said monitoring, said control means performs control to reduce said transfer current value when said tension force is large and increase said transfer current value when said tension force is small.

8. An image forming method for forming a toner image on a continuous medium, comprising the steps of:

forming a toner image on a rotating image forming drum:

transferring, to said continuous medium, the toner image on said rotating image forming drum by causing an electrostatic force to act on said image forming drum and said continuous medium, which is being conveyed, at a transfer position via a transfer current; and monitoring a tension force applied by said image forming drum on said continuous medium and controlling the value of said transfer current in accordance with the results of said monitoring.

9. The image forming method according to claim 8, wherein said monitoring step comprises a step of monitoring a printing ratio from print data used to form said toner image on said image forming drum.

10. The image forming method according to claim 9, wherein said controlling step comprises a step of performing control to reduce said transfer current value when said printing ratio is low and increase said transfer current value when said printing ratio is high.

11. The image forming method according to claim 9, wherein said controlling step comprises a step of controlling said transfer current value in accordance with the results of said monitoring of the printing ratio after a prescribed delay interval following the point in time at which said monitoring is performed.

12. The image forming method according to claim 8, wherein said monitoring step comprises a step of monitoring the current supplied to a motor for rotating said image forming.

13. The image forming method according to claim 12, wherein said controlling step comprises a step of performing control to reduce said transfer current value when said motor current value is large and increase said transfer current value when said motor current value is small.

14. The image forming method according to claim 8, wherein said controlling step comprises a step of performing control to reduce said transfer current value when said tension force is large and increase said transfer current value when said tension force is small.

* * * * *

UNITED STATES PATENT AND TRADEMARK OFFICE

CERTIFICATE OF CORRECTION

PATENT NO. : 6,694,114 B2
DATED : February 17, 2004
INVENTOR(S) : Masato Matsuduki et al.

It is certified that error appears in the above-identified patent and that said Letters Patent is hereby corrected as shown below:

Title page,
Item [73], Assignee, please correct the name "Fujitsu Limited" to be -- Fuji Xerox Co., Ltd. --.

Signed and Sealed this

Twenty-fifth Day of October, 2005

JON W. DUDAS
*Director of the United States Patent and Trademark Office*